US011117379B2

(12) United States Patent
Fukasawa et al.

(10) Patent No.: US 11,117,379 B2
(45) **Date of Patent: *Sep. 14, 2021**

(54) INK REPLENISH CONTAINER

(71) Applicant: Seiko Epson Corporation, Tokyo (JP)

(72) Inventors: Noriyuki Fukasawa, Shiojiri (JP); Taku Ishizawa, Matsumoto (JP); Tadashi Watanabe, Matsumoto (JP); Ryoichi Tanaka, Shiojiri (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 10 days.

This patent is subject to a terminal disclaimer.

(21) Appl. No.: 16/675,851

(22) Filed: Nov. 6, 2019

(65) Prior Publication Data

US 2020/0070523 A1 Mar. 5, 2020

Related U.S. Application Data

(62) Division of application No. 15/617,682, filed on Jun. 8, 2017, now Pat. No. 10,471,723.

(30) Foreign Application Priority Data

Jun. 10, 2016 (JP) ..... 2016-116155
Oct. 17, 2016 (JP) ..... 2016-203332
(Continued)

(51) Int. Cl.
*B41J 2/175* (2006.01)

(52) U.S. Cl.
CPC ..... *B41J 2/17509* (2013.01); *B41J 2/1752* (2013.01); *B41J 2/1754* (2013.01); *B41J 2/17506* (2013.01); *B41J 2/17553* (2013.01)

(58) Field of Classification Search
CPC ..... B41J 2/17509
See application file for complete search history.

(56) References Cited

U.S. PATENT DOCUMENTS 5,874,976 A 2/1999 Katon et al.
5,920,333 A 7/1999 Bates
(Continued)

FOREIGN PATENT DOCUMENTS

CN 1269749 A 10/2000
CN 1313233 A 9/2001
(Continued)

OTHER PUBLICATIONS

U.S. Appl. No. 15/617,782, filed Jun. 8, 2017, Seiko Epson Corporation.
(Continued)

*Primary Examiner* — Justin Seo
(74) *Attorney, Agent, or Firm* — Oliff PLC

(57) ABSTRACT

An ink replenish container comprises a container main body that is able to store the ink; an ink outlet formation member, attached to a front end side of the container main body, to form an ink outlet; and a cap attachable to a front end side of the ink outlet formation member. The ink outlet includes an outer circumferential surface and an inner circumferential surface located inward of the outer circumferential surface, the inner circumferential surface surrounding an opening through which the ink passes. The cap includes a first protrusion that is configured to contact with the outer circumferential surface of the ink outlet to form a first exit seal portion, and a second protrusion that is configured to contact with the inner circumferential surface of the ink outlet to form a second exit seal portion.

3 Claims, 13 Drawing Sheets

(30) Foreign Application Priority Data

Oct. 25, 2016 (JP) ..... 2016-208864
Mar. 1, 2017 (JP) ..... 2017-037829

(56) References Cited

U.S. PATENT DOCUMENTS

| | | | |
|---|---|---|---|
| D424,442 | S | 5/2000 | Kreiseder |
| 6,076,920 | A | 6/2000 | Zapata et al. |
| 6,079,823 | A | 6/2000 | Droege |
| 6,164,768 | A | 12/2000 | Murphy et al. |
| 6,779,672 | B2 | 8/2004 | Kano et al. |
| D513,180 | S | 12/2005 | Lindsey et al. |
| 7,014,055 | B2 | 3/2006 | Kano et al. |
| 7,300,138 | B2 | 11/2007 | Corner et al. |
| 7,360,876 | B2 | 4/2008 | Inoue et al. |
| 7,458,665 | B2 | 12/2008 | Batista et al. |
| 7,607,770 | B2 | 10/2009 | Inoue et al. |
| 7,887,166 | B2 | 2/2011 | Guhse et al. |
| 7,980,686 | B2 | 7/2011 | Guhse et al. |
| 8,020,719 | B2 | 9/2011 | Maiwald et al. |
| 9,090,075 | B2 | 7/2015 | Matsumoto et al. |
| 9,186,902 | B2 | 11/2015 | Ishizawa et al. |
| 9,199,769 | B2 | 12/2015 | Wood et al. |
| 9,592,675 | B2 | 3/2017 | Matsumoto et al. |
| 9,662,893 | B2 | 5/2017 | Mori et al. |
| 9,718,276 | B2 | 8/2017 | Tomoguchi |
| 9,994,037 | B2 | 6/2018 | Sakai |
| 10,105,960 | B2 | 10/2018 | Tomoguchi |
| 10,286,676 | B2 | 5/2019 | Kimura et al. |
| 10,350,896 | B2 | 7/2019 | Ishizawa et al. |
| 10,350,901 | B2 | 7/2019 | Mizutani et al. |
| 10,369,800 | B2 | 8/2019 | Rooney et al. |
| 2001/0027957 | A1 | 10/2001 | Kano |
| 2004/0060893 | A1 | 4/2004 | Kano et al. |
| 2004/0061748 | A1 | 4/2004 | Kuwabara et al. |
| 2005/0011916 | A1 | 1/2005 | Battista et al. |
| 2005/0151809 | A1 | 7/2005 | Corner et al. |
| 2005/0270342 | A1 | 12/2005 | Ogura et al. |
| 2006/0017787 | A1 | 1/2006 | Inoue et al. |
| 2006/0108378 | A1 | 5/2006 | Cohen et al. |
| 2007/0171263 | A1 | 7/2007 | Inoue et al. |
| 2009/0096836 | A1 | 4/2009 | Haines et al. |
| 2009/0101644 | A1 | 4/2009 | Maiwald et al. |
| 2010/0201761 | A1 | 8/2010 | Lu et al. |
| 2012/0125481 | A1 | 5/2012 | Matsumoto et al. |
| 2012/0152978 | A1 | 6/2012 | Sekiyama et al. |
| 2013/0258004 | A1 | 10/2013 | Kyotani |
| 2014/0104349 | A1 | 4/2014 | Kimura et al. |
| 2014/0158660 | A1 | 6/2014 | Wood et al. |
| 2015/0077487 | A1 | 3/2015 | Ishizawa et al. |
| 2015/0124028 | A1 | 5/2015 | Kimura et al. |
| 2015/0283816 | A1 | 10/2015 | Kimura et al. |
| 2016/0016408 | A1 | 1/2016 | Matsumoto et al. |
| 2016/0121619 | A1 | 5/2016 | Tomoguchi |
| 2016/0200110 | A1 | 7/2016 | Matsushita et al. |
| 2016/0200111 | A1 | 7/2016 | Kimura et al. |
| 2017/0120606 | A1 | 5/2017 | Koshikawa et al. |
| 2017/0282570 | A1 | 10/2017 | Yamaguchi |
| 2017/0313089 | A1 | 11/2017 | Matsushita et al. |
| 2017/0355194 | A1 | 12/2017 | Fukasawa et al. |
| 2017/0355195 | A1 | 12/2017 | Fukasawa et al. |
| 2017/0368833 | A1 | 12/2017 | Tomoguchi |
| 2019/0299624 | A1 | 10/2019 | Mizutani et al. |

FOREIGN PATENT DOCUMENTS

| | | | |
|---|---|---|---|
| CN | 101412450 | A | 4/2009 |
| CN | 101444997 | A | 6/2009 |
| CN | 102126351 | A | 7/2011 |
| CN | 101804736 | B | 12/2011 |
| CN | 202138070 | U | 2/2012 |
| CN | 204382821 | U | 6/2015 |
| CN | 105564038 | A | 5/2016 |
| CN | 207291315 | U | 5/2018 |
| EP | 3 075 540 | A1 | 10/2016 |
| JP | S58-107348 | A | 6/1983 |
| JP | 3021835 | U | 3/1996 |
| JP | H09-020018 | A | 1/1997 |
| JP | H09-294955 | A | 11/1997 |
| JP | H10-216612 | A | 8/1998 |
| JP | H11-123834 | A | 5/1999 |
| JP | 2001-002097 | A | 1/2001 |
| JP | 2001-088317 | A | 4/2001 |
| JP | 2001-146021 | A | 5/2001 |
| JP | 2003-305865 | A | 10/2003 |
| JP | 2004-142442 | A | 5/2004 |
| JP | 2004-142447 | A | 5/2004 |
| JP | 2005-028859 | A | 2/2005 |
| JP | 2006-263960 | A | 10/2006 |
| JP | 2008-200912 | A | 9/2008 |
| JP | 2010-076428 | A | 4/2010 |
| JP | 2010-240907 | A | 10/2010 |
| JP | 2011-230840 | A | 11/2011 |
| JP | 2012-106363 | A | 6/2012 |
| JP | 2012-131068 | A | 7/2012 |
| JP | 2013-226830 | A | 11/2013 |
| JP | 2014-008640 | A | 1/2014 |
| JP | 2014-079909 | A | 5/2014 |
| JP | 2014-088207 | A | 5/2014 |
| JP | 2014-091257 | A | 5/2014 |
| JP | 2015-058543 | A | 3/2015 |
| JP | 2015-178280 | A | 10/2015 |
| JP | 2016-041595 | A | 3/2016 |
| JP | 2016-087844 | A | 5/2016 |
| JP | 2016-102824 | A | 6/2016 |
| JP | 2016-190402 | A | 11/2016 |
| JP | 2016-203404 | A | 12/2016 |
| JP | 2016-203991 | A | 12/2016 |
| JP | 2017-039517 | A | 2/2017 |
| WO | 2004028817 | A1 | 4/2004 |
| WO | WO-2014/084264 | A1 | 6/2014 |
| WO | WO-2015/079547 | A1 | 6/2015 |
| WO | WO-2016/060019 | A1 | 4/2016 |
| WO | 2017/020915 | A1 | 2/2017 |

OTHER PUBLICATIONS

International Search Report dated Aug. 22, 2017 in PCT/JP2017/021057 with English-language translation (4 pgs.).
International Search Report dated Aug. 22, 2017 in PCT/JP2017/021276 with English-language translation (4 pgs.).
Office Action dated Feb. 13, 2018 in co-pending U.S. Appl. No. 15/615,525 (10 pgs.).
Office Action dated May 31, 2018 in co-pending U.S. Appl. No. 15/617,782 (8 pgs.).
Final Office Action dated Sep. 4, 2018 in co-pending U.S. Appl. No. 15/615,525 (11 pgs.).
Final Office Action on U.S. Appl. No. 15/617,834 dated Mar. 26, 2019.

INK REPLENISH CONTAINER

CROSS REFERENCE TO RELATED APPLICATIONS this application is a divisional of U.S. application Ser. No. 15/617,682, filed Jun. 8, 2017; which claims the benefit of priority based on Japanese Patent Application No. 2016-116155 filed on Jun. 10, 2016, Japanese Patent Application No. 2016-203332 filed on Oct. 17, 2016, Japanese Patent Application No. 2016-208864 filed on Oct. 25, 2016 and Japanese Patent Application No. 2017-37829 filed on Mar. 1, 2017, the entire disclosures of which are hereby incorporated by reference.

BACKGROUND

Field

The present disclosure relates to an ink replenish container which replenishes an ink to the ink tank of a printer.

Related Art

An inkjet printer is provided with an ink tank for storing ink, and the ink is supplied from the ink tank to a print head. There are two types of ink tanks for the printers, a cartridge type and an ink replenish type. The ink tank of the cartridge type is replaced with a new ink tank when the remaining amount of ink becomes low. As for the ink tank of the ink replenish type, even when the remaining amount of ink becomes low, the ink tank is used without being replaced, and the ink is replenished from an ink replenish container.

JP2016-087844A discloses an ink replenish container which is used for replenishing an ink to the ink tank of the ink replenish type.

When an ink replenish container is used, the ink replenish container replenishes an ink to an ink tank in a position or attitude in which its ink outlet is directed downward, whereas when the ink replenish container is not used, the ink replenish container is stored in a position or attitude in which the ink outlet is directed upward. Since the ink replenish container often takes various positions or attitudes, it may be important to ensure the sealability of the ink. Depending on the configuration of the ink replenish container, not only when it is used but also when it is manufactured or stored, the problem in the sealability of the ink and other structural problems may occur. However, conventionally, sufficient improvements on the structure of the ink replenish container have not been made, and thus further improvements are desired.

SUMMARY

The present disclosure is made to solve at least part of the foregoing problems, and may be realized as aspects or application examples below.

(1) According to an aspect of the disclosure, there is provided an ink replenish container for replenishing an ink to an ink tank of a printer. The ink replenish container comprises: a container main body that is able to store the ink; an ink outlet formation member, attached to a front end side of the container main body, to form an ink outlet; and a cap attachable to a front end side of the ink outlet formation member. The ink outlet includes an outer circumferential surface and an inner circumferential surface located inward of the outer circumferential surface, and the inner circumferential surface surrounds an opening through which the ink passes. The cap includes a first protrusion that is configured to contact with the outer circumferential surface of the ink outlet to form a first exit seal portion, and a second protrusion that is configured to contact with the inner circumferential surface of the ink outlet to form a second exit seal portion.

In the above ink replenish container, since the second exit seal portion is formed on the inner circumferential surface of the ink outlet, it is possible to reduce such a problem that outer portions of the ink outlet which are outer than the inner circumferential surface become smeared by the ink. Moreover, since the two exit seal portions are formed with the outer circumferential surface and the inner circumferential surface of the ink outlet, it is possible to more reliably reduce the leakage of the ink from the ink outlet.

(2) In the above aspect, a distance from a bottom of the container main body to a back end position of the second exit seal portion on the container main body side may be shorter than a distance from the bottom of the container main body to a back end position of the first exit seal portion on the container main body side.

In this configuration, when the cap is to be attached, the second exit seal portion on the inner circumferential side starts to perform the sealing before the first exit seal portion on the outer circumferential side, and thus it is possible to decrease the volume of the space formed between the inner side of the cap and the ink outlet formation member. Accordingly, it is possible to reduce the internal pressure of the container main body.

(3) The ink replenish container may further comprise: an exit valve attached to the ink outlet at a position that is closer to the back end of the container main body than the opening of the ink outlet is. The ink outlet may include a third protrusion that is configured to contact with the exit valve to form a third exit seal portion. In a radial direction with a center axis of the ink replenish container being an axial center, the second exit seal portion may be formed at a position closer to the center axis of the ink replenish container than the third exit seal portion is.

In this configuration, as compared with a case where the second exit seal portion and the third exit seal portion are formed in positions which are equidistant from the center axis of the ink replenish container, distortion which may occur in the second exit seal portion is unlikely to be transmitted to the third tubular protrusion, and thus it is possible to relieve deterioration of the sealing performance of the third exit seal portion between the third tubular protrusion and the exit valve.

The present disclosure may be realized in various aspects other than the ink replenish container described above. For example, the present disclosure may be realized in aspects such as an ink replenish system which includes an ink tank and an ink replenish container.

DESCRIPTION OF EMBODIMENTS

Figure 1:
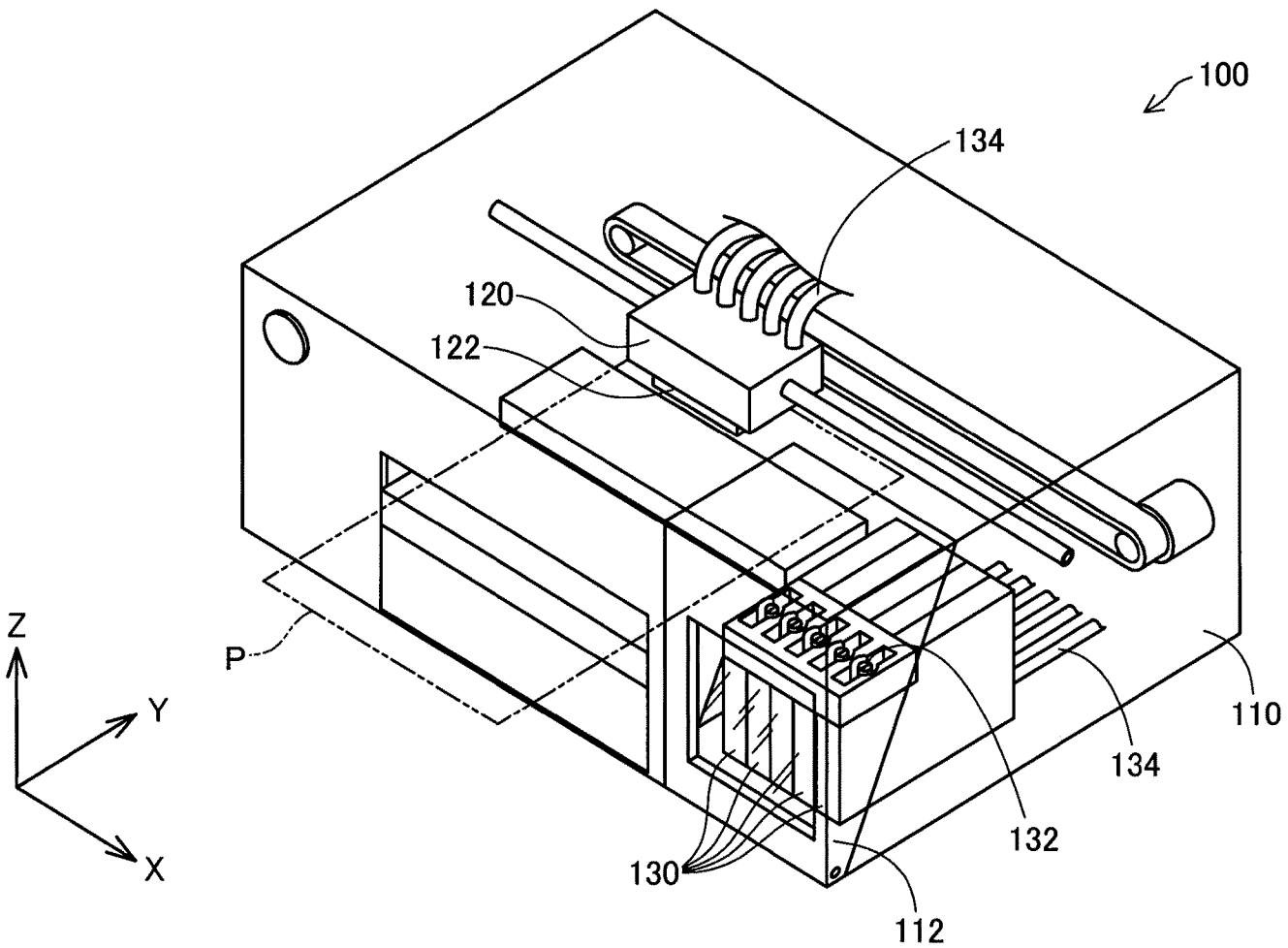
FIG. 1 is a perspective view of a printer according to an embodiment.

FIG. 1 is a perspective view of a printer 100 according to an embodiment. The printer 100 is an inkjet printer which discharges an ink onto a print medium P so as to perform printing. FIG. 1 shows X, Y and Z axes which are perpendicular to each other. The X axis corresponds to the width direction of the printer 100, the Y axis corresponds to the depth direction of the printer 100, and the Z axis corresponds to the height direction of the printer 100. The printer 100 is installed on a horizontal installation plane which is defined by the X direction and the Y direction.

The printer 100 includes a housing 110. The housing 110 is provided with a carriage 120 which is able to move in a main scanning direction (or X direction). On the lower surface of the carriage 120, there is installed a print head 122 which discharges the ink onto the print medium P. One end of the front surface of the housing 110 is provided with a lid 112 which is operable to be opened and closed. A plurality of ink tanks 130 are installed within the lid 112.

The ink tanks 130 are connected with tubes 134 to the print head 122 of the carriage 120. The inks within each of the ink tanks 130 are supplied through the tubes 134 to the print head 122. These ink tanks 130 are of the ink replenish type. On the upper surface of each of the ink tanks 130, a cylindrical ink inlet flow path member 132 for use in replenishing the ink to the ink tank 130 is protruded. These ink tanks 130 are stationary-type ink tanks that are not placed on the carriage 120. The front surface of each ink tank 130 is formed of a transparent member, and thus it is possible to visually check the remaining amount of ink in each ink tank 130 from the outside. When the remaining amount of ink is lowered, it is possible to open the lid 112 so as to replenish the ink from the ink inlet flow path member 132 of the ink tank 130.

In the present specification, the term "replenish of the ink" means an operation of replenishing the ink to the ink tank 130 to increase the remaining amount of ink. However, it is not necessary to fill the ink tank 130 with the ink by the "replenish of the ink". The term "replenish of the ink" includes an operation of filling an empty ink tank 130 with the ink when the printer 100 is first used.

Figure 2:
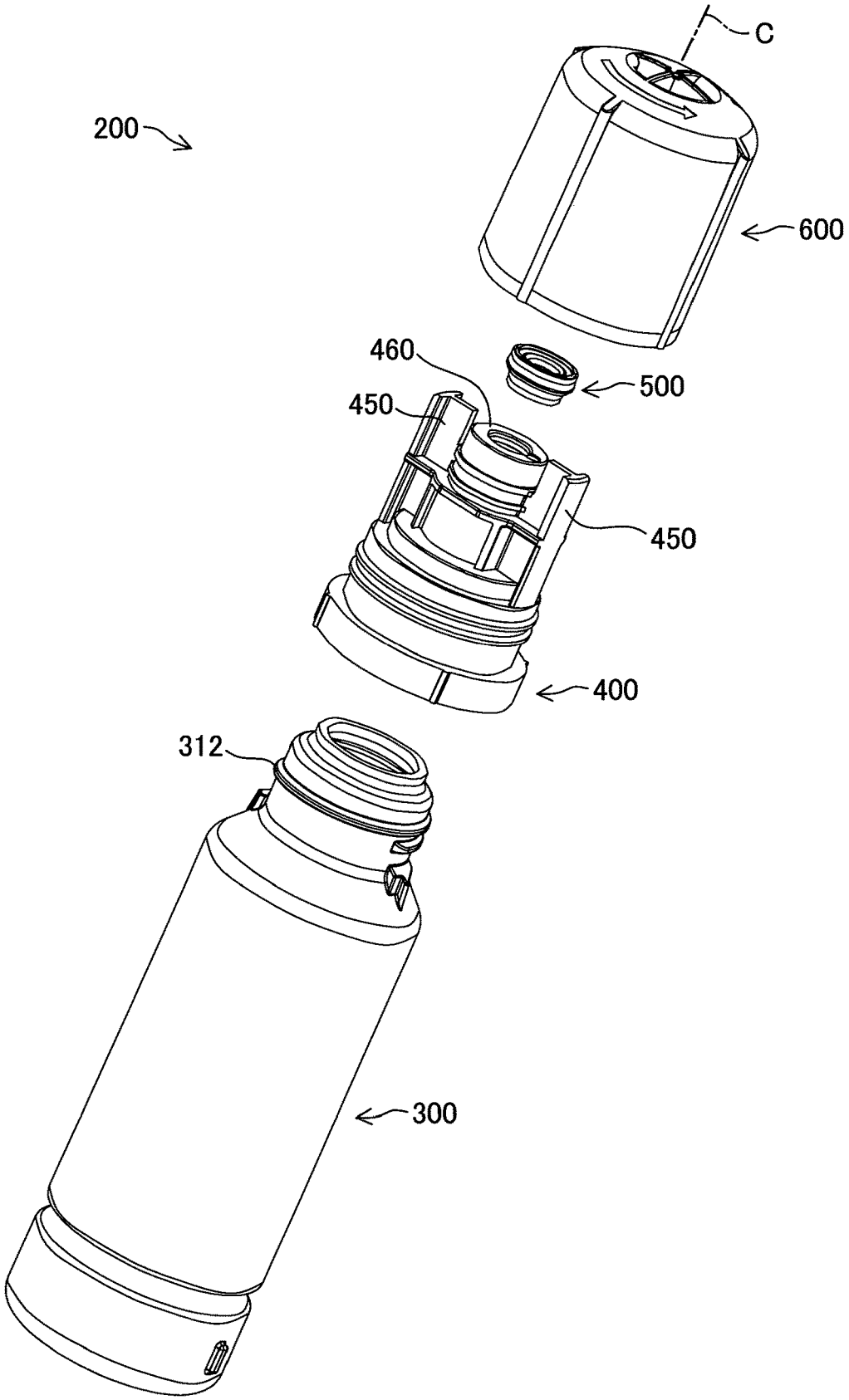
FIG. 2 is an exploded perspective view of an ink replenish container according to the embodiment.

FIG. 2 is an exploded perspective view of an ink replenish container 200 according to the embodiment. The ink replenish container 200 includes: a container main body 300 which may store the ink; an ink outlet formation member 400 which forms an ink outlet 460, an exit valve 500; and a cap 600 which may be attached to the front end side of the ink outlet formation member 400. The container main body 300 is a hollow cylindrical container which has an opening on the front end side. An outer screw 312 is formed around a small-diameter portion at the front end of the container main body 300 for use in fitting the ink outlet formation member 400 to the container main body 300. The ink outlet formation member 400 has an ink outlet 460 at its front end. The exit valve 500 is inserted from the back end side of the ink outlet formation member 400 and is installed immediately below the ink outlet 460. In other words, the exit valve 500 is attached to the ink outlet 460 at a position that is closer to the back end side than the opening of the ink outlet 460 is. The definition of "back end side" will be explained later. In FIG. 2, however, the exit valve 500 is drawn between the cap 600 and the ink outlet formation member 400 for convenience of illustration. The exit valve 500 may be regarded as a member which constitutes part of the ink outlet formation member 400. When replenishing ink to the ink tank 130, the ink inlet flow path member 132 (FIG. 1) of the ink tank 130 is inserted into the ink outlet 460.

Around the ink outlet 460, fitting portions 450 are provided which are fitted into recess portions that are provided around the ink inlet flow path member 132 of the ink tank 130. In the present embodiment, the fitting portions 450 are provided on both sides so as to sandwich the ink outlet 460. These two fitting portions 450 have a rotationally symmetric shape of 180 degrees with the center axis C of the ink replenish container 200 in the center. Likewise, the recess portions provided around the ink inlet flow path member 132 of the ink tank 130 have a rotationally symmetric shape of 180 degrees with the ink inlet flow path member 132 in the center. When replenishing the ink, the fitting portions 450 of the ink replenish container 200 are fitted into the recess portions around the ink inlet flow path member 132 of the ink tank 130, and thus the direction of the ink replenish container 200 is limited to the two directions which are rotationally symmetric at 180 degrees. Consequently, it is possible to keep the ink replenish container 200 in a stable position when the ink is replenished. However, the fitting portions 450 may be omitted.

In the present specification, a direction which is parallel to the center axis C of the ink replenish container 200 is referred to as an "axial direction", and a direction which is extended outward from the center axis C is referred to as a "radial direction". In a plane perpendicular to the center axis C, a circle around the center axis C is referred to as a "circle around the center axis C".

Figure 3:
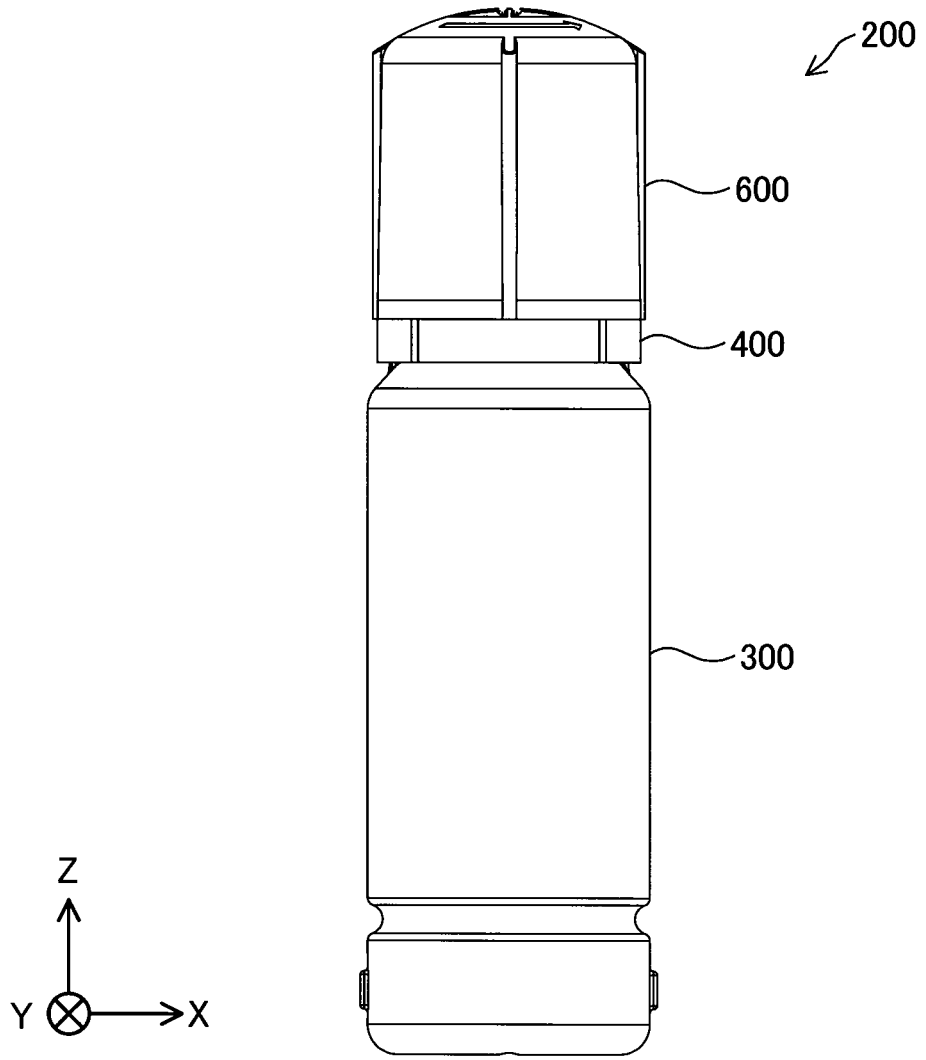
FIG. 3 is a front view of the ink replenish container according to the embodiment.

FIG. 3 is a front view of the ink replenish container 200 in a properly placed state. The "properly placed state of the ink replenish container 200" means a state where the container main body 300 is placed on a horizontal surface of a desk or the like with the bottom of the container main body 300 directed downward. The upper end side of the ink replenish container 200 in the properly placed state is referred to as the "the front end side", and the lower end side is referred to as the "the back end side". The Z direction in the figures subsequent to FIG. 3 indicates a direction which is directed vertically and upward in the properly placed state of the ink replenish container 200.

Figure 4:
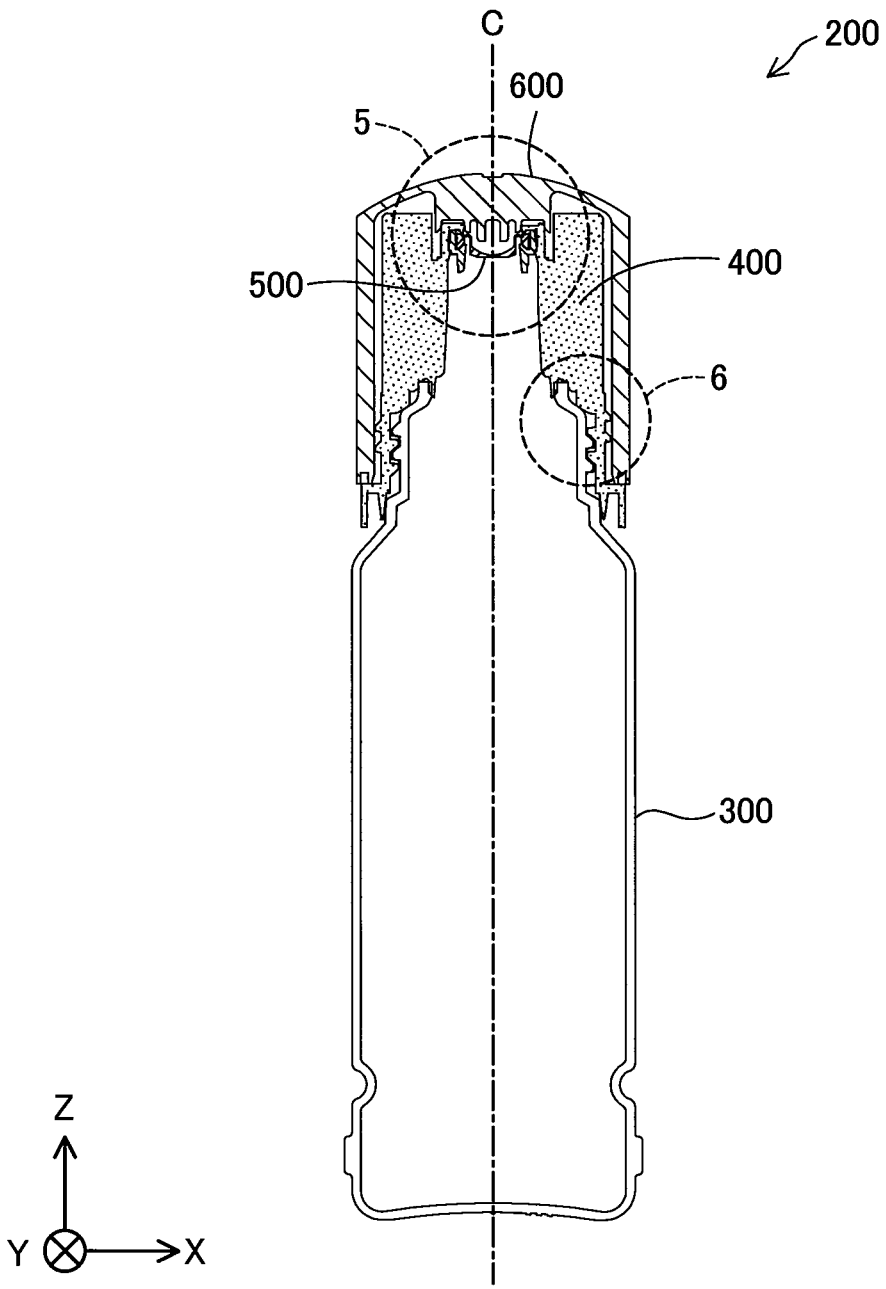
FIG. 4 is a vertical cross-sectional view of the ink replenish container according to the embodiment.
Figure 5:
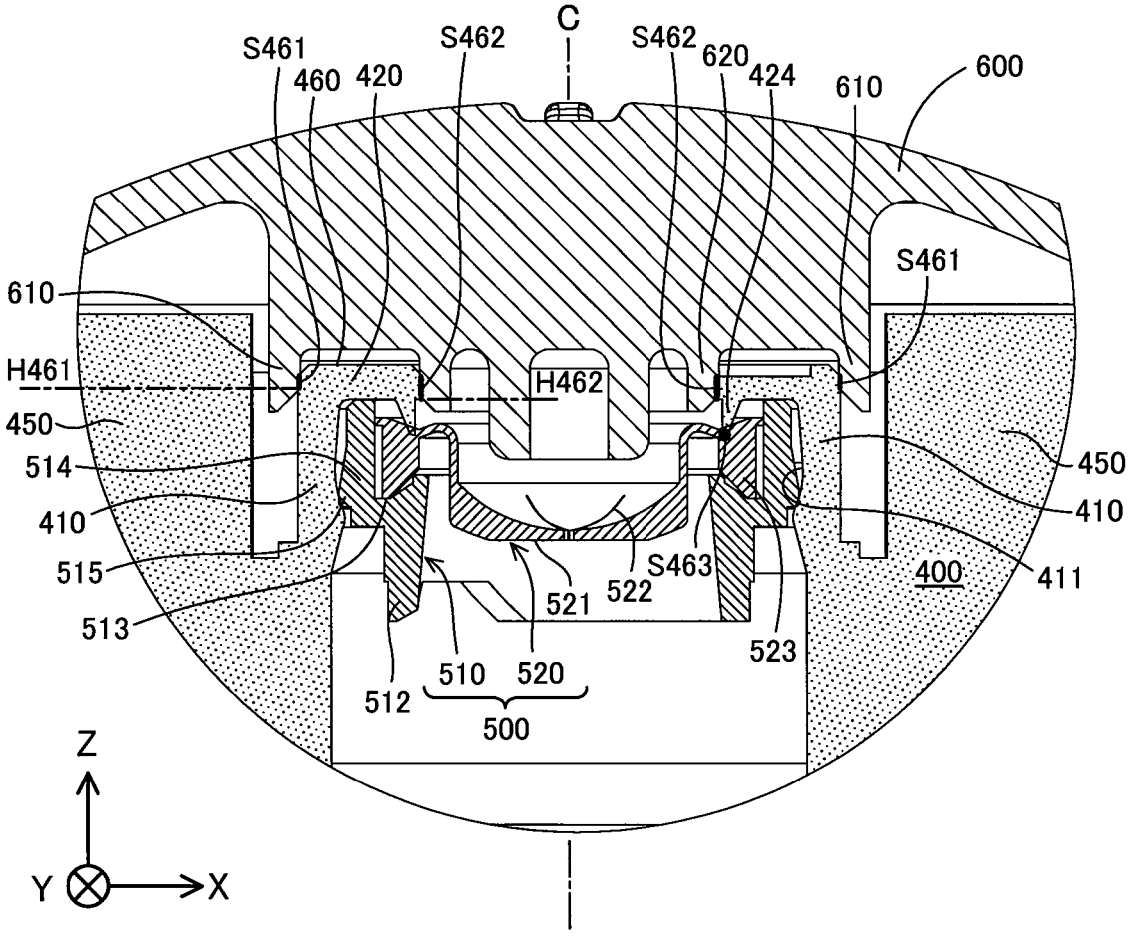
FIG. 5 is an enlarged view of the region 5 of FIG. 4.

FIG. 4 is a vertical cross-sectional view of the ink replenish container 200, and FIG. 5 is an enlarged view of the region 5 of FIG. 4. As described with reference to FIG. 2, the ink outlet 460 is provided between the two fitting portions 450 of the ink outlet formation member 400. The ink outlet 460 includes a hollow cylindrical portion 410 which is extended parallel to the center axis C and a tubular exit ring portion 420 which is provided on the front end side of the hollow cylindrical portion 410. In the center of the ink outlet 460, there is provided an opening through which the ink passes.

The exit valve 500 is installed within the ink outlet 460. The exit valve 500 is inserted from the back end side of the ink outlet formation member 400 and is installed within the ink outlet 460. The exit valve 500 includes a valve main body 520 and a retaining ring 510 which retains the valve main body 520.

The retaining ring 510 of the exit valve 500 includes a first tubular portion 512 and a second tubular portion 514 which is provided on the front end side of the first tubular portion 512. The second tubular portion 514 is larger in inner diameter than the first tubular portion 512. In a boundary portion between the first tubular portion 512 and the second tubular portion 514, there is provided a recess portion 513 which is recessed toward the back end side. The valve main body 520 includes a slit valve 521 and a hollow cylindrical support portion 523 which is provided around the slit valve 521. The back end of the support portion 523 is supported by the recess portion 513 of the retaining ring 510. On the outer surface of the second tubular portion 514 of the retaining ring 510, there is provided a protrusion portion 515 which protrudes outward. On the inner surface of the hollow cylindrical portion 410 of the ink outlet 460, there is provided a recess portion 411. The protrusion portion 515 on the outer surface of the second tubular portion 514 of the retaining ring 510 enters the recess portion 411 in the inner surface of the hollow cylindrical portion 410 of the ink outlet 460 so as to be fitted thereinto, and thus the retaining ring 510 is retained within the ink outlet 460.

A plurality of slits 522 are made in the vicinity of the center of the slit valve 521. These slits 522 act such that they open outward when the internal pressure of an ink bottle is higher than the atmosphere, whereas they close according to their elastic action when the internal pressure is substantially equal to the atmosphere. The slit valve 521 is preferably formed of a silicone rubber or an elastomer which is a member having rubber elasticity. The ink supply container 200 other than the slit valve 521 may be formed of, for example, a thermoplastic resin such as polyethylene or polypropylene.

A first protrusion 610 and a second protrusion 620 are provided on the inner surface of the cap 600. In the present embodiment, the first protrusion 610 and the second protrusion 620 are hollow cylindrical portions which are extended parallel to the center axis C toward the back end side. In other words, the first protrusion 610 and the second protrusion 620 have a concentric annular shape with the center axis C of the ink replenish container 200 in the center. The second protrusion 620 is located inward of the first protrusion 610 in the radial direction or closer to the center axis C of the ink replenish container 200. The exit ring portion 420 is arranged between a first exit seal portion S461 and a second exit seal portion S462. The first protrusion 610 contacts with the outer circumferential surface of the ink outlet 460 to make the first exit seal portion S461. The second protrusion 620 contacts with the inner circumferential surface of the ink outlet 460 to make the second exit seal portion S462. The inner circumferential surface of the ink outlet 460 is located inward of the outer circumferential surface of the ink outlet 460. In the embodiment, the back ends of the first protrusion 610 and the second protrusion 620 are chamfered to adjust the lengths of the first exit seal portion S461 and the second exit seal portion S462.

On the inner circumferential side of the exit ring portion 420 at the front end of the ink outlet 460, there is formed a third protrusion 424 which is protruded toward the back end side. In the present embodiment, the third protrusion 424 has a substantially tubular shape. The cross section of the third protrusion 424 in the X-Z plane has a substantially triangular shape, and one corner thereof forms the back end of the third protrusion 424. The back end of the third protrusion 424 contacts with a recess portion, which is provided in the upper surface of the valve main body 520 of the exit valve 500, to make a third exit seal portion S463. The third exit seal portion S463 is made in a boundary portion between the support portion 523 of the valve main body 520 and the slit valve 521. The third exit seal portion S463 is located outward, in the radial direction, of the second exit seal portion S462 formed between the inner circumferential surface of the ink outlet 460 and the second protrusion 620 of the cap 600. In other words, the second exit seal portion S462 is formed in a position closer to the center axis C of the ink replenish container 200 than the third exit seal portion S463 is, in the radial direction with the center axis C of the ink replenish container 200 being an axial center.

In the portion shown in FIG. 5, the following places have seal portions which have the function of sealing the ink or the air.

<Sealing Places between the Ink Outlet Formation Member 400 and the Cap 600>

(1) Between the inner circumferential surface of the first protrusion 610 of the cap 600 and the outer circumferential surface of the ink outlet 460 (the first exit seal portion S461).

(2) Between the outer circumferential surface of the second protrusion 620 of the cap 600 and the inner circumferential surface of the ink outlet 460 (the second exit seal portion S462).

<Sealing Places between the Exit Valve 500 and the Ink Outlet Formation Member 400>

(1) Between the back end of the third protrusion 424 of the ink outlet formation member 400 and the recess portion in the upper surface of the slit valve 521 (the third exit seal portion S463).

(2) Between the protrusion portion 515 on the outer side of the second tubular portion 514 of the retaining ring 510 and the recess portion 411 on the inner side of the hollow cylindrical portion 410 of the ink outlet formation member 400.

<Sealing Place between the Components of the Exit Valve 500>

(1) Between the back end of the support portion 523 of the slit valve 521 and the recess portion of the retaining ring 510.

As described above, in the ink replenish container 200 of the present embodiment, the seal portions are formed at a plurality of places, and thus the ink replenish container 200 has an advantage in that it is possible to seal the ink or the air at a plurality of places.

In the present embodiment, the back end height H462 of the second exit seal portion S462 is lower than the back end height H461 of the first exit seal portion S461. Here, the back end heights H461 and H462 mean distances which are measured vertically and upward from the bottom surface of the container main body 300 when the ink replenish container 200 is placed in the properly placed state (FIG. 3). An effect produced by such a difference between the back end heights H461 and H462 will be described later.

Figure 6:
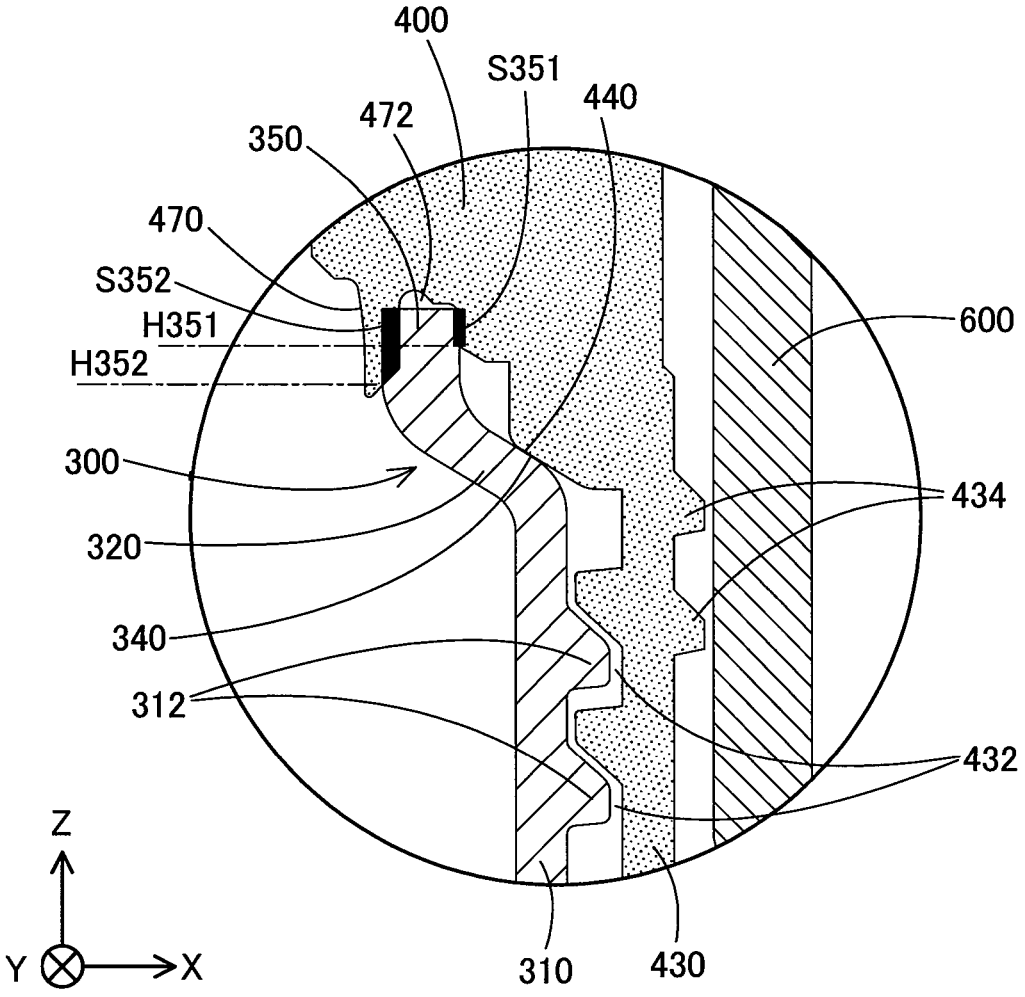
FIG. 6 is an enlarged view of the region 6 of FIG. 4.

FIG. 6 is an enlarged view of the region 6 of FIG. 4. A screw formation portion 310 is provided at the front end portion of the container main body 300, and a front end engagement portion 350 is provided further on the front end side of the screw formation portion 310. The screw formation portion 310 and the front end engagement portion 350 each have a hollow cylindrical shape. The outside diameter of the front end engagement portion 350 is smaller than the outside diameter of the screw formation portion 310. A reduced diameter portion 320 is provided between the front end engagement portion 350 and the screw formation portion 310. The outer screw 312 (FIG. 2) is formed on the outer circumferential surface of the screw formation portion 310. A shoulder portion 340 is formed at the front end side of the screw formation portion 310 in the container main body 300. The shoulder portion 340 corresponds to the outer inclined surface of the reduced diameter portion 320.

A screw formation portion 430 is provided in the vicinity of the back end of the ink outlet formation member 400. The screw formation portion 430 has an inner screw 432 on its inner circumferential surface, and protrusions 434 on its outer circumferential surface. The protrusions 434 on the outer circumferential surface of the screw formation portion 430 narrow a gap with the inner surface of the cap 600, and have the function of preventing a phenomenon in which the ink leaks from the inner portion of the cap 600 to the outside. The inner screw 432 of the screw formation portion 430 engages with the outer screw 312 of the container main body 300. The ink outlet formation member 400 is screwed to the container main body 300 with the inner screw 432 and the outer screw 312. On the inner surface of the ink outlet formation member 400, there is provided a cylindrical engagement protrusion 470 which engages with the front end engagement portion 350 of the container main body 300. The engagement protrusion 470 makes an engagement recess portion 472 at its outer circumferential side, into which the front end engagement portion 350 of the container main body 300 is inserted.

The inner portion of the ink outlet formation member 400 has an abutting portion 440 which abuts the shoulder portion 340 at the front end side of the screw formation portion 310 in the container main body 300. In other words, as the ink outlet formation member 400 is screwed to the container main body 300, the shoulder portion 340 of the reduced diameter portion 320 in the container main body 300 abuts the abutting portion 440 of the ink outlet formation member 400, and thus the screwing is completed. In a state where the screwing is completed, the front end engagement portion 350 of the container main body 300 engages with the engagement recess portion 472 of the ink outlet formation member 400, and the front end engagement portion 350 contacts with the inner surfaces of the engagement recess portion 472 to make two main body seal portions S351 and S352. The first main body seal portion S351 is on the outer circumferential side of the front end engagement portion 350, and the second main body seal portion S352 is on the inner circumferential side of the front end engagement portion 350. In the present embodiment, the engagement recess portion 472 is formed such that the back end height H352 of the second main body seal portion S352 on the inner circumferential side is lower than the back end height H351 of the first main body seal portion S351 on the outer circumferential side. The back end heights H351 and H352 are distances which are measured from the bottom surface of the container main body 300.

Figure 7:
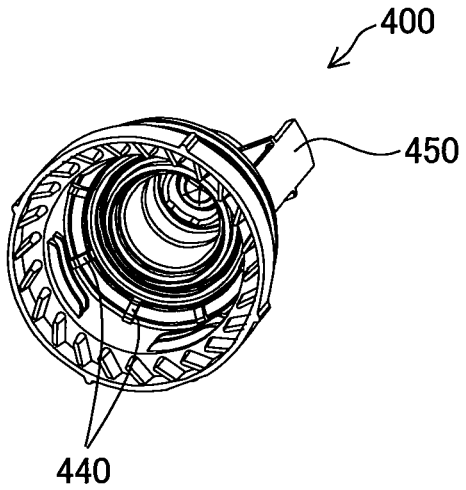
FIG. 7 is a perspective view when an ink outlet formation member is seen from the side of a back end.
Figure 8:
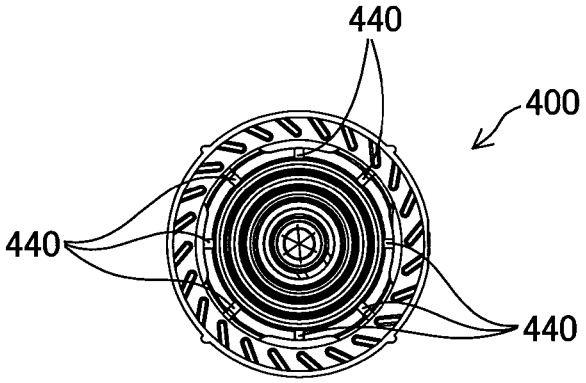
FIG. 8 is a back view of the ink outlet formation member.
Figure 9:
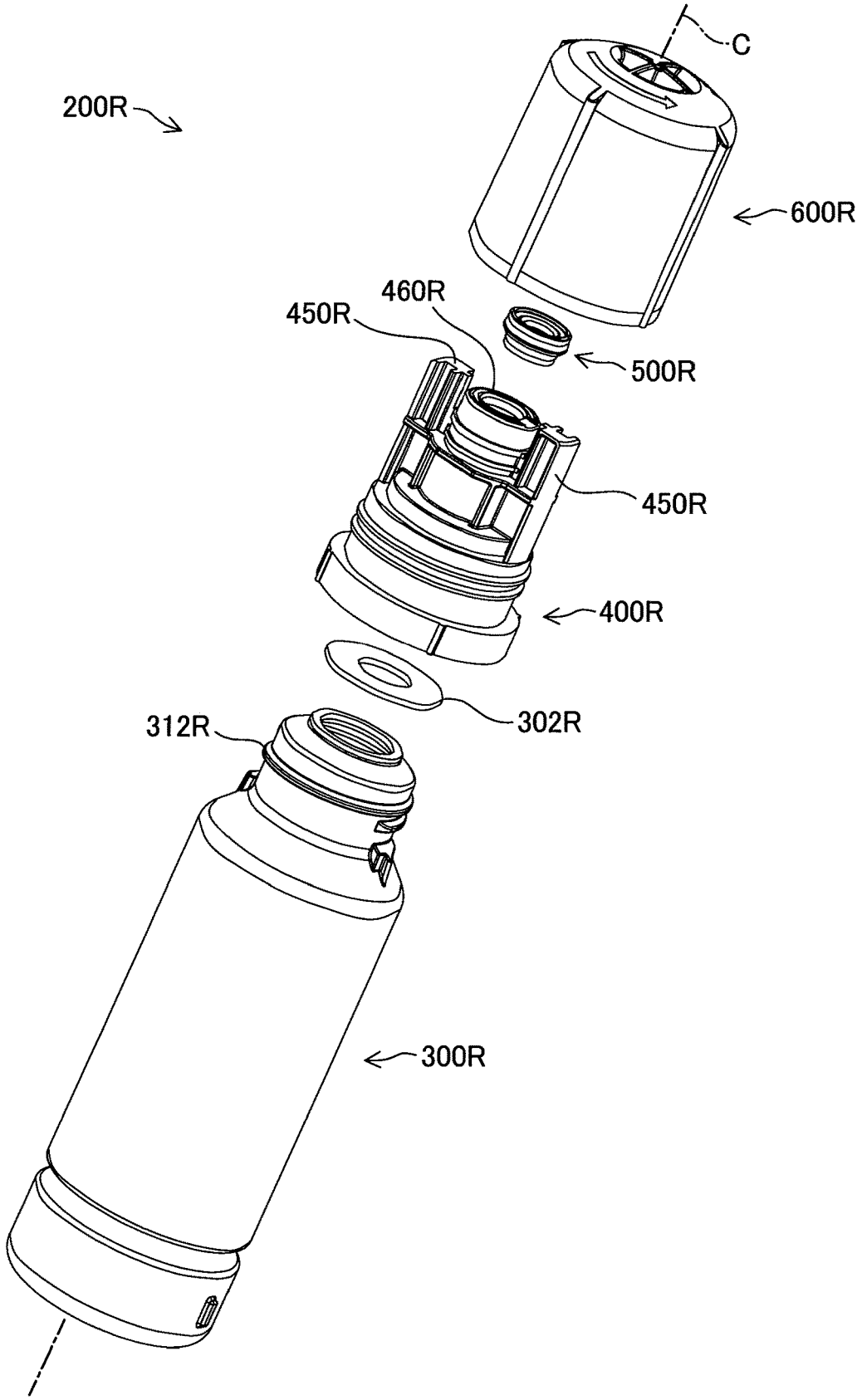
FIG. 9 is an exploded perspective view of an ink replenish container in a reference example.
Figure 10:
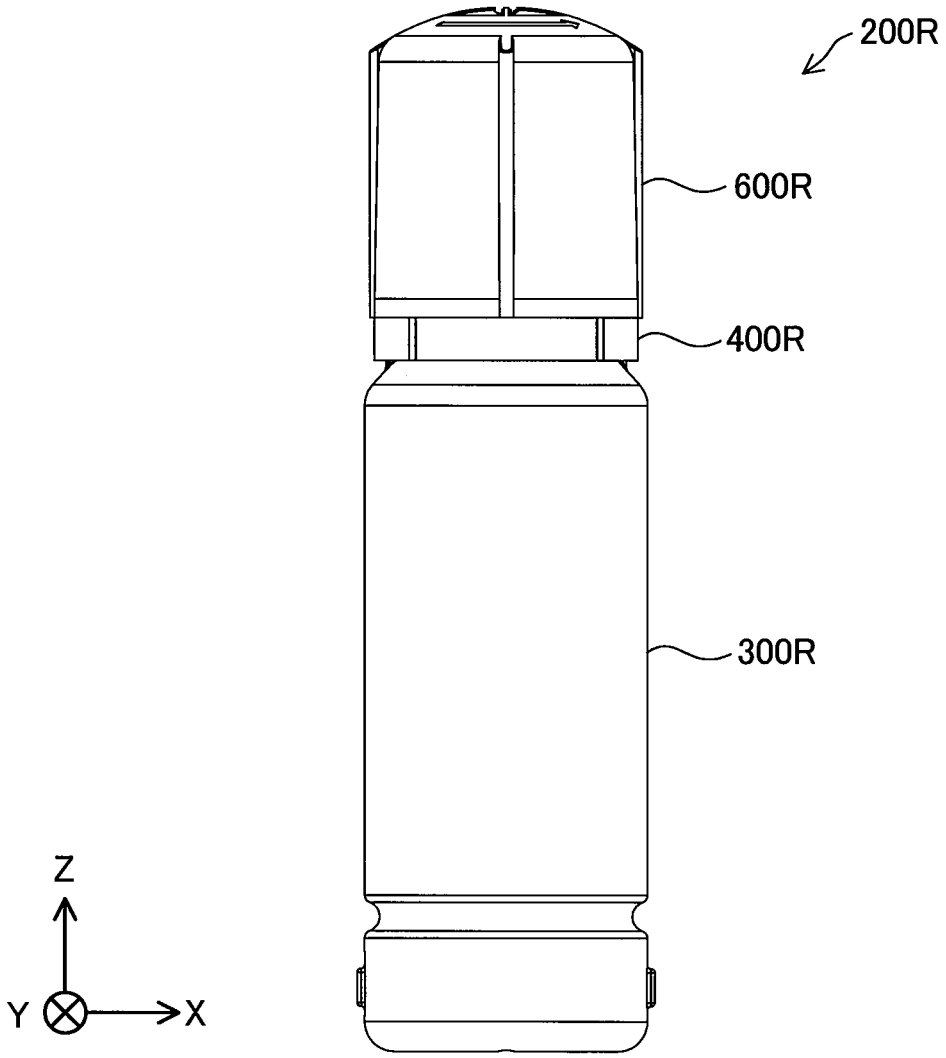
FIG. 10 is a front view of the ink replenish container in the reference example.
Figure 11:
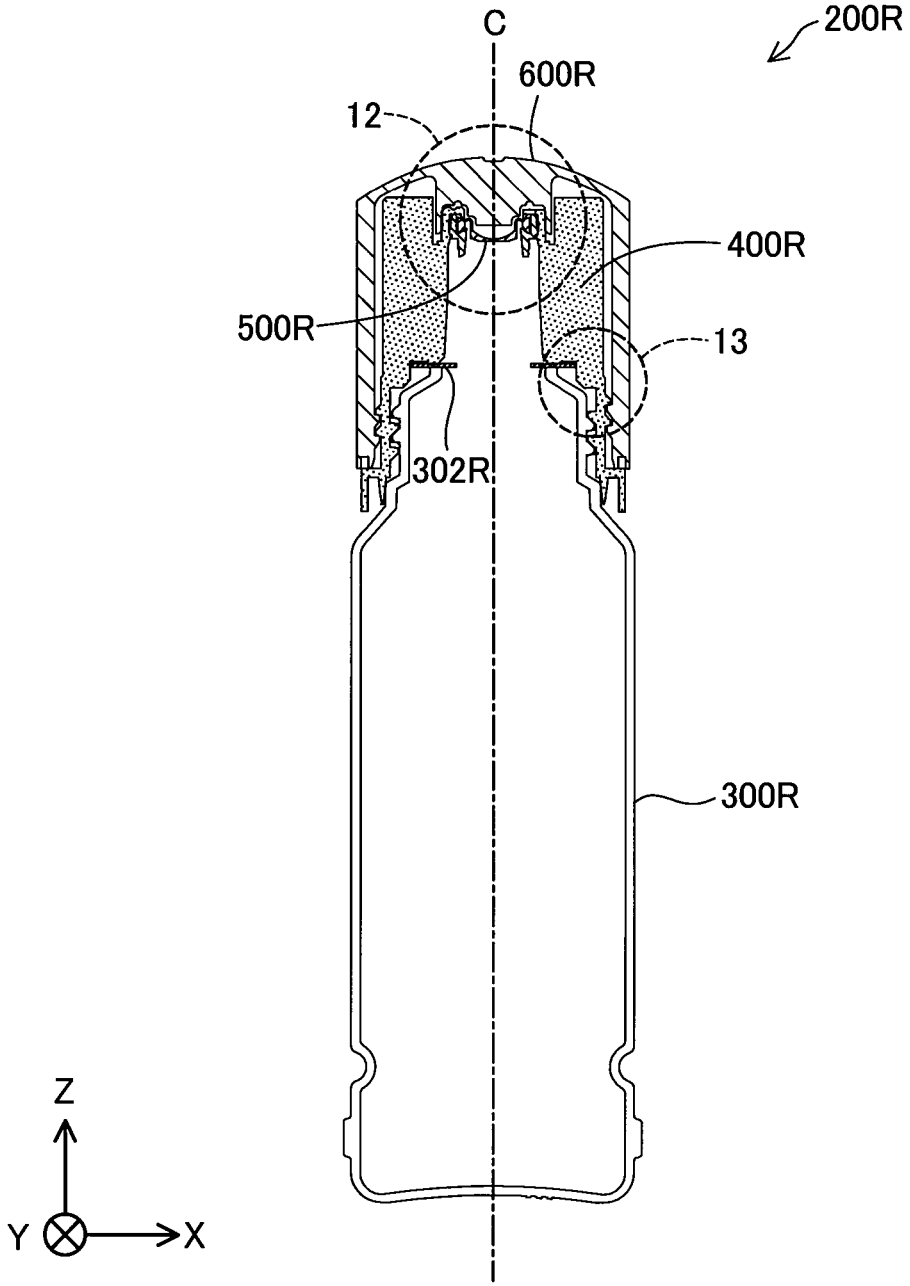
FIG. 11 is a vertical cross-sectional view of the ink replenish container in the reference example.
Figure 12:
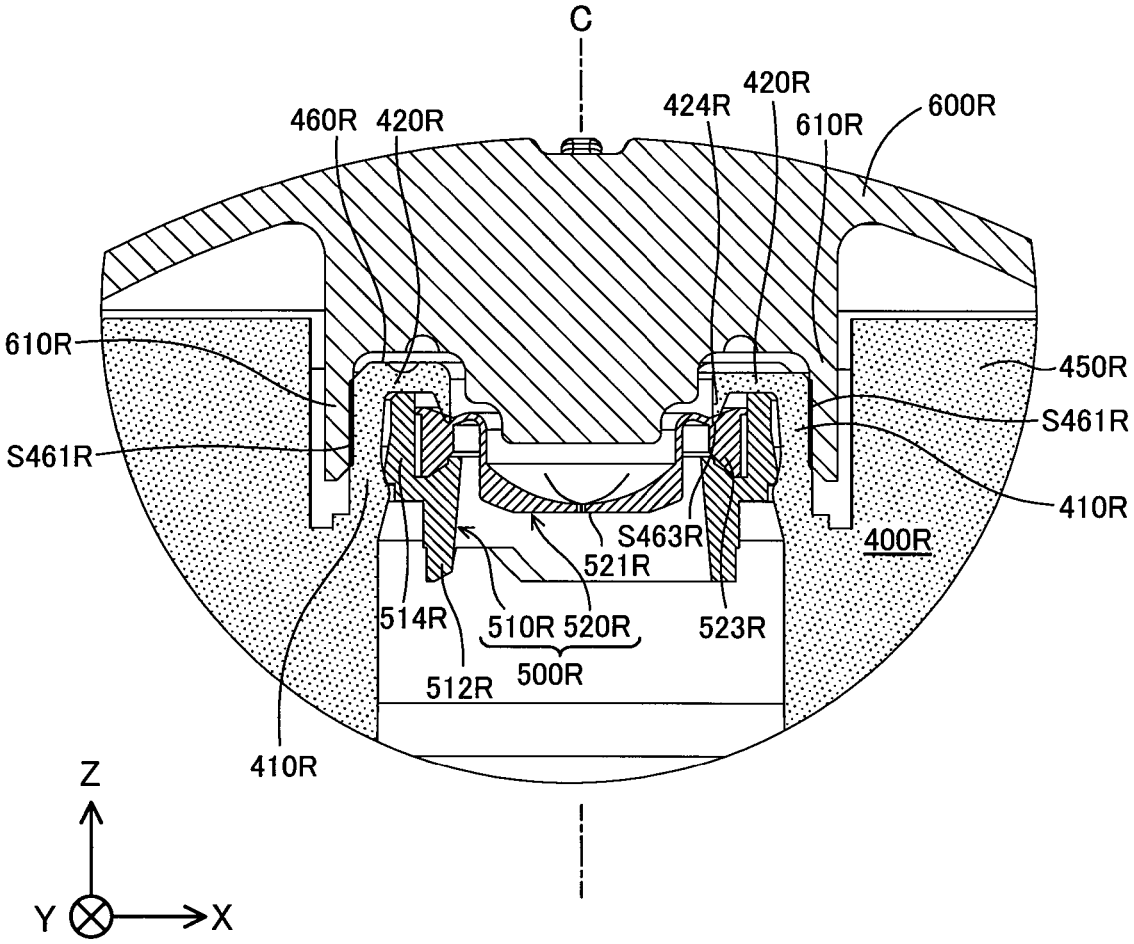
FIG. 12 is a partially enlarged view of the region 12 of FIG. 11.
Figure 13:
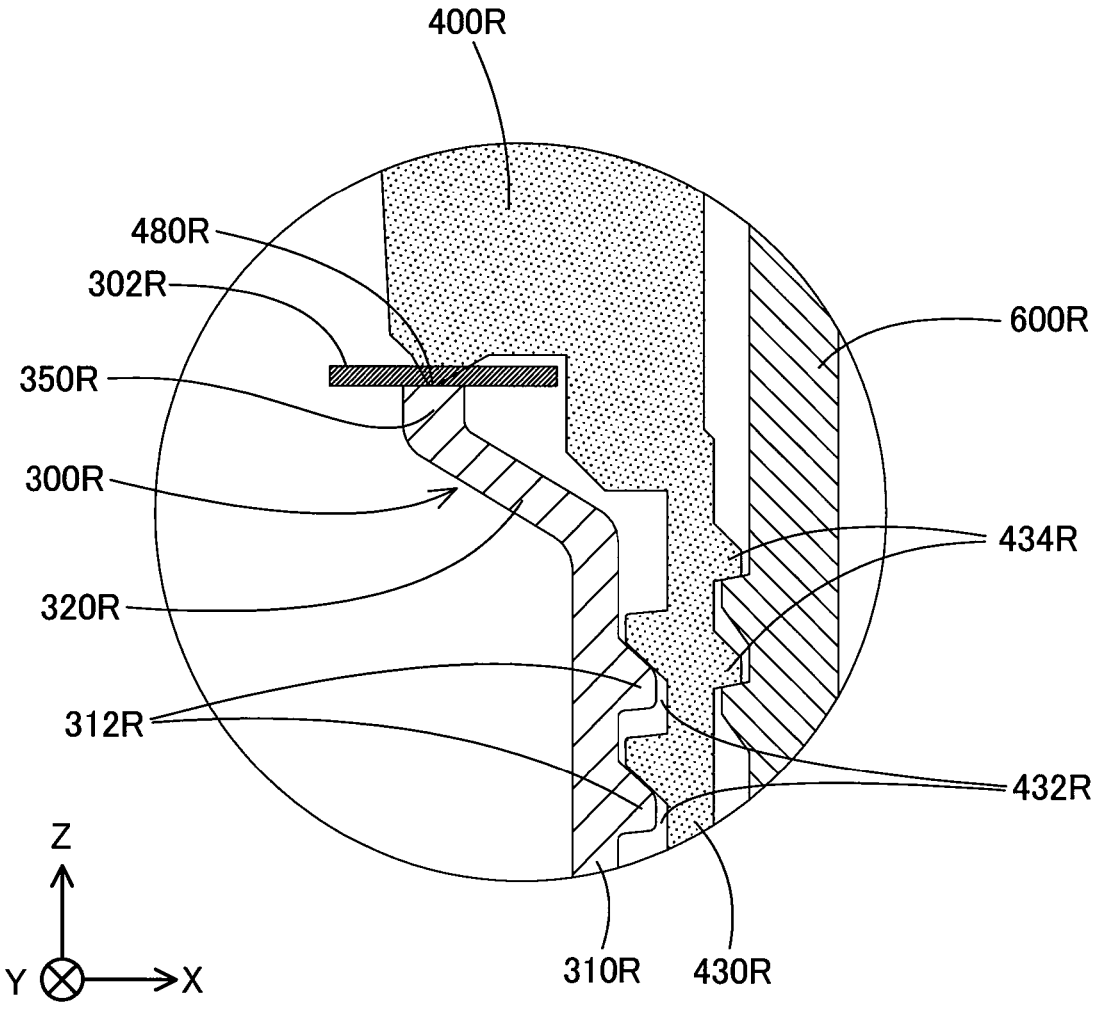
FIG. 13 is a partially enlarged view of the region 13 of FIG. 11.

FIG. 7 is a perspective view when the ink outlet formation member 400 is seen from the back end side, and FIG. 8 is a back view of the ink outlet formation member 400. The abutting portion 440 of the ink outlet formation member 400 may be formed as a portion which is continuous over the entire circumference of a circle around the center axis C of the ink supply container 200. In the present embodiment, as shown in FIGS. 7 and 8, a plurality of rib-shaped abutting portions 440 each extending in the radial direction are separately provided at a plurality of places on the circumference (circumferential direction) around the center axis C. The rib-shaped abutting portions 440 are partially protruded from the inner surface of the ink outlet formation member 400. A gap is formed between the portion between the adjacent rib-shaped abutting portions 440 and the shoulder portion 340 of the reduced diameter portion 320 in the container main body 300. Hence, it is possible to prevent the area between the screw formation portion 310 of the container main body 300 and the screw formation portion 430 of the ink outlet formation member 400 from being sealed with the abutting portions 440 to make a closed space.

As with the abutting portions 440, the outer screw 312 (FIG. 6) of the screw formation portion 310 in the container main body 300 is preferably configured to be non-continuous, and notches are preferably provided at one or more places in the outer screw 312. In this way, it is possible to prevent the area between the outer screw 312 of the container main body 300 and the inner screw 432 of the ink outlet formation member 400 to make a closed space. The advantages of the structure of FIG. 6 will be further described later.

FIGS. 9 to 13 are diagrams showing the structure of an ink supply container 200R in a reference example, and respectively correspond to FIGS. 2 to 6 in the embodiment. In the portions which correspond to those of the ink supply container 200 in the embodiment, "R" is added to the ends of the reference numerals thereof which are used in FIGS. 2 to 6. The detailed description of the individual portions of the ink replenish container 200R in the reference example will be omitted.

The structural features of the ink supply container 200 of the embodiment shown in FIGS. 2 to 6 will be sequentially described below while the embodiment is compared with the reference example if necessary.

(A) The Structural Feature 1 of the Ink Supply Container:

In the ink replenish container 200 (FIG. 5) of the embodiment, (i) the contact portion between the inner circumferential surface of the first protrusion 610 of the cap 600 and the outer circumferential surface of the ink outlet 460 forms the first exit seal portion S461, and (ii) the contact portion between the outer circumferential surface of the second protrusion 620 of the cap 600 and the inner circumferential surface of the ink outlet 460 forms the second exit seal portion S462. By contrast, in the reference example (FIG. 12), a seal portion which corresponds to the second exit seal portion S462 is not present. In the embodiment, since the second exit seal portion S462 is formed on the inner circumferential surface of the ink outlet 460, it is possible to reduce a trouble in which the surface (that is, the upper surface of the exit ring portion 420) of the ink outlet 460 on the front end side becomes smeared with the ink. Furthermore, in the embodiment, since the two exit seal portions S461 and S462 are formed on the outer circumferential surface and the inner circumferential surface of the ink outlet 460, it is possible to more reliably reduce the leakage of the ink from the ink outlet 460 in a state where the cap 600 is attached.

(B) The Structural Feature 2 of the Ink Supply Container:

In the ink supply container 200 (FIG. 5) of the embodiment, the back end height H462 of the second exit seal portion S462 is located lower than the back end height H461 of the first exit seal portion S461. In other words, the distance H462 from the bottom of the container main body 300 to the back end position of the second exit seal portion S462 on the container main body 300 side is shorter than the distance H461 from the bottom of the container main body 300 to the back end position of the first exit seal portion S461 on the container main body 300 side. By the adoption of such a configuration, when the cap 600 is attached, the second exit seal portion S462 on the inner circumferential side starts to perform the sealing before the first exit seal portion S461 on the outer circumferential side does. In other words, in the second exit seal portion S462 on the inner circumferential side, as compared with the first exit seal portion S461 on the outer circumferential side, the contact of the members with each other is started earlier. Consequently, it is possible to decrease the volume of a space formed between the inner portion of the cap 600 and the ink outlet formation member 400. Here, assume a structure in which the first exit seal portion S461 on the outer circumferential side starts to perform the sealing before the second exit seal portion S462 on the inner circumferential side dose. In this imaginary structure, when the cap 600 is attached, the volume of the space formed between the inner portion of the cap 600 and the ink outlet formation member 400 is increased as compared with the embodiment, and when the cap 600 is completely closed, the pressure of the closed space therewithin is increased as compared with the embodiment. When the pressure of the closed space within the cap 600 is increased, the air within the closed space may pass through the slit valve 521 to go into the container main body 300, thereby increasing the internal pressure of the container main body 300. When the internal pressure of the container main body 300 is increased, it is likely that when the ink supply container 200 is used to replenish the ink to the ink tank 130, the slit valve 521 rapidly opens to jet out the ink due to the internal pressure as well as the application of the hydraulic head of the ink to the slit valve 521. On the other hand, in the ink replenish container 200 of the embodiment, since the back end height H462 of the second exit seal portion S462 on the inner circumferential side is located lower than the back end height H461 of the first exit seal portion S461 on the outer circumferential surface, as compared with the imaginary structure, it is possible to decrease the volume of the space formed between the inner portion of the cap 600 and the ink outlet formation member 400. Consequently, it is possible to reduce a possibility that the ink is unnecessarily jetted out from the ink supply container 200.

(C) The Structural Feature 3 of the Ink Replenish Container:

In the ink supply container 200 (FIG. 5) of the embodiment, the second exit seal portion S462 formed between the cap 600 and the ink outlet 460 is formed closer to the center axis C of the ink supply container 200 than the third exit seal portion S463 formed between the ink outlet 460 and the exit valve 500. Here, assume a structure in which the exit seal portions S462 and S463 at two places are provided in positions which are equidistant from the center axis C of the ink replenish container 200. In this imaginary structure, when the cap 600 is attached, the cap 600 and the ink outlet 460 make contact with each other to cause distortion in the second exit seal portion S462 (that is, between the second protrusion 620 and the ink outlet 460), and this distortion is easily transmitted to the third protrusion 424 of the ink outlet 460. This may deform the third protrusion 424, and deteriorate the seal performance of the third exit seal portion S463 formed between the third protrusion 424 and the exit valve 500. In the ink supply container 200 of the embodiment, as compared with the imaginary structure described above, distortion which occurs in the second exit seal portion S462 is unlikely to be transmitted to the third protrusion 424, and thus it is possible to reduce the deterioration of the seal performance of the third exit seal portion S463 formed between the third protrusion 424 and the exit valve 500.

(D) The Structural Feature 4 of the Ink Supply Container:

In the ink replenish container 200 (FIG. 6) of the embodiment, when the center of the container main body 300 is the axial center, the outside diameter of the front end engagement portion 350 in the container main body 300 is set smaller than the outside diameter of the screw formation portion 310. Consequently, the main body seal portions S351 and S352 between the container main body 300 and the ink outlet formation member 400 are formed at positions closer to the center axis C of the ink supply container 200 than the screw formation portion 310 of the container main body 300 is. Here, assume a structure in which the outside diameters of the front end engagement portion 350 and the screw formation portion 310 are equal to each other. In this imaginary structure, the circumferential lengths of the main body seal portions S351 and S352 are longer than in the embodiment, and thus the seal performance of the main body seal portions S351 and S352 may be slightly lowered. In other words, in the ink replenish container 200 of the embodiment, the circumferential lengths of the main body seal portions S351 and S352 are reduced so as to be shorter, and thus it is possible to enhance the seal performance. On the other hand, when another imaginary structure is considered in which the outside diameters of the front end engagement portion 350 and the screw formation portion 310 are set equal to each other while the diameter of the screw formation portion 310 in the container main body 300 is decreased such that the circumferential lengths of the main body seal portions S351 and S352 are substantially equal to those in the embodiment, the volume of the container main body 300 is disadvantageously reduced. On the other hand, in the ink supply container 200 of the embodiment, the outside diameter of the screw formation portion 310 is larger than the outside diameter of the front end engagement portion 350 in the container main body 300, and thus it is possible to reduce an excessive decrease in the volume of the container main body 300. As described above, the outside diameter of the front end engagement portion 350 in the container main body 300 is set smaller than the outside diameter of the screw formation portion 310, and thus it is possible to reduce an excessive decrease in the volume of the container main body 300 while enhancing the seal performance.

As far as the effect of the structural feature 4 described above is concerned, it is not necessary to form the two main body seal portions S351 and S352 in the front end engagement portion 350, and either one of the main body seal portions S351 and S352 may be provided. The ink replenish container 200 may be configured to form only one main body seal portion in the front end engagement portion 350. The latter structure is shown in, for example, FIG. 13 of the reference example.

(E) The Structural Feature 5 of the Ink Supply Container:

In the ink replenish container 200 (FIG. 6) of the embodiment, the back end height H351 of the first main body seal portion S351 on the outer circumferential side of the front end engagement portion 350 is located higher than the back end height H352 of the second main body seal portion S352 on the inner circumferential side. In other words, the distance H351 from the bottom of the container main body 300 to the position of the back end of the first main body seal portion S351 on the container main body 300 side is longer than the distance H352 from the bottom of the container main body 300 to the position of the back end of the second main body seal portion S352 on the container main body 300 side. With such a configuration, when the ink outlet formation member 400 is attached to the container main body 300 at the time of, for example, the manufacturing of the ink replenish container 200, the second main body seal portion S352 on the inner circumferential side starts to perform the sealing before the first main body seal portion S351 on the outer circumferential side does. In other words, in the second main body seal portion S352 on the inner circumferential side, the contact of the members with each other is started earlier as compared with the first main body seal portion S351 on the outer circumferential side. Here, consider an imaginary structure in which the second main body seal portion S352 on the inner circumferential side is not present. In this imaginary structure, the area on the inner side of the first main body seal portion S351 becomes a closed space surrounded by the container main body 300 and the ink outlet formation member 400, and thus the volume of the closed space is relatively large. On the other hand, in the ink replenish container 200 of the embodiment, the area on the inner side of the second main body seal portion S352 on the inner circumferential side becomes a closed space surrounded by the container main body 300 and the ink outlet formation member 400, and thus it is possible to decrease the volume of the closed space surrounded by the container main body 300 and the ink outlet formation member 400 as compared with the imaginary structure. In the imaginary structure described above, after the sealing is started in the first main body seal portion S351, as the ink outlet formation member 400 is further screwed, the internal pressure of the container main body 300 may be disadvantageously increased. On the other hand, in the ink supply container 200 of the embodiment, the sealing is first started in the second main body seal portion S352 on the inner circumferential side, and thus it is possible to reduce a possibility that the internal pressure of the container main body 300 is excessively increased.

(F) The Structural Feature 6 of the Ink Supply Container:

The ink supply container 200 (FIG. 6) of the embodiment is configured to make the shoulder portion 340, which is provided in the portion on the front end side of the screw formation portion 310 in the container main body 300, to abut the abutting portion 440 of the ink outlet formation member 400. Hence, as the ink outlet formation member 400 is screwed to the container main body 300, the shoulder portion 340 of the screw formation portion 310 abuts the abutting portion 440 of the ink outlet formation member 400, and thus the screwing is completed. Here, a stress between the shoulder portion 340 and the abutting portion 440 is transmitted along the axial direction of the ink replenish container 200 to the screw formation portion 310 on the back end side of the shoulder portion 340. By contrast, in the reference example (FIG. 13), the screwing is completed in a state where an abutting portion 480R provided on the inner surface of an ink outlet formation member 400R is pressed onto the surface of the front end of a front end engagement portion 350R in a container main body 300R through a seal member 302R. In the reference example, since the abutting portion 480R is located closer to the center axis C of the ink replenish container 200R than a screw formation portion 310R is, the front end engagement portion 350R is pressed by the abutting portion 480R so as to be deformed in the axial direction or the radial direction, thereby deteriorating the seal performance of the seal member 302R sandwiched between the abutting portion 480R and the front end engagement portion 350R. On the other hand, in the ink replenish container 200 of the embodiment, a stress between the shoulder portion 340 on the front end side of the screw formation portion 310 in the container main body 300 and the abutting portion 440 is transmitted along the axial direction of the ink replenish container 200, and thus the front end engagement portion 350 is prevented from being deformed. Hence, it is possible to reduce a possibility that the seal performance between the container main body 300 and the ink outlet formation member 400 is damaged.

(G) The Structural Feature 7 of the Ink Replenish Container:

In the ink replenish container 200 (FIG. 6) of the embodiment, as the abutting portion 440 of the ink outlet formation member 400 includes a plurality of rib-shaped abutting portions 440 separately at a plurality of places on the circumference around the center axis C. In this structure, in the portion between the adjacent rib-shaped abutting portions 440, the gap is formed between the shoulder portion 340 of the container main body 300 and the ink outlet formation member 400. Hence, it is possible to prevent the space between the screw formation portion 430 of the ink outlet formation member 400 and the container main body 300 from being sealed with the shoulder portion 340 and the abutting portions 440 such that the space becomes a closed space. When the ink supply container 200 is manufactured, vacuum packing may be performed in which after the container main body 300 is loaded with the ink, the interior of the container main body 300 is reduced in pressure and then the entire ink replenish container 200 is wrapped with a sealing material. In a case where the vacuum packing is performed, when a closed space is present between the container main body 300 and the ink outlet formation member 400, it is impossible to sufficiently reduce the pressure of the closed space, with the result that the ink may be insufficiently degassed. On the other hand, in the ink replenish container 200 of the embodiment, it is possible to reduce a possibility that the ink is insufficiently degassed when the vacuum packing is performed. Since the ink may be sufficiently degassed, it is possible to replenish the ink having a small number of minute bubbles to the ink tank 130.

The various types of structural features described above are individually and arbitrarily adoptable, and the other structural features may be omitted. In other words, as the ink supply container, a container which adopts one or more structural features selected from the structural features described above may be realized.

Variations:

The present disclosure is not limited to the embodiment described above and variations thereof, and may be practiced in various aspects without departing from the spirit thereof.

Variation 1:

Part of the members of the ink supply container 200 according to the embodiment may be arbitrarily omitted or changed. For example, the exit valve 500 or the cap 600 may be omitted. Part or the whole of the container main body 300 may be made of a flexible bag member.

Variation 2:

The present disclosure is applicable not only to ink storage containers such as an ink replenish container but also to other types of liquid storage containers which store liquids other than ink.

What is claimed is:

1. An ink replenish container for replenishing an ink to an ink tank of a printer, comprising:

a container main body that is able to store the ink;

an ink outlet formation member, attached to a front end side of the container main body, to form an ink outlet; and a cap attachable to a front end side of the ink outlet formation member, wherein the ink outlet includes an outer circumferential surface of the ink outlet and an inner circumferential surface located inward of the outer circumferential surface, the inner circumferential surface surrounding an opening through which the ink passes, an exit valve being attached to the ink outlet at a position that is closer to a back end of the container main body than the opening of the ink outlet is, the cap includes a protrusion of a concentric annular shape whose center is a center axis of the ink replenish container, the protrusion having a seal portion that is contactable to the inner circumferential surface, and the exit valve includes a valve main body and a retaining ring that retains the valve main body, the valve main body including a slit valve and a hollow cylindrical support portion provided around the slit valve, a back end of the hollow cylindrical support portion being supported by a recess portion of the retaining ring.

2. The ink replenish container according to claim 1, wherein the ink outlet further includes a contact portion that contacts a peripheral portion of the valve at the front end side.

3. The ink replenish container according to claim 2, wherein in a radial direction with a center axis of the ink replenish container being an axial center, the seal portion is formed at a position closer to the center axis of the ink replenish container than the contact portion is.

* * * * *